United States Patent [19]

Piggott

[11] Patent Number: 4,610,650

[45] Date of Patent: Sep. 9, 1986

[54] PLASTIC BAG HANDLE FORMING APPARATUS

[75] Inventor: David C. Piggott, Ontario, Canada

[73] Assignee: PCL Packaging Limited, Oakville, Canada

[21] Appl. No.: 577,712

[22] Filed: Feb. 7, 1984

[51] Int. Cl.[4] ..... B31B 1/64

[52] U.S. Cl. ..... 493/204; 493/461; 83/566

[58] Field of Search ..... 83/566; 493/461, 926, 493/226, 198, 204, 209

[56] References Cited

U.S. PATENT DOCUMENTS

| | | | |
|---|---|---|---|
| 3,685,251 | 8/1972 | Mahoffy | 83/566 |
| 3,779,138 | 12/1973 | Lindstadt | 493/461 |
| 4,466,318 | 8/1984 | Schad | 83/566 |

FOREIGN PATENT DOCUMENTS

| | | |
|---|---|---|
| 976397 | 10/1975 | Canada . |
| 985544 | 3/1976 | Canada . |
| 987151 | 4/1976 | Canada . |

*Primary Examiner*—Leon Gilden

*Attorney, Agent, or Firm*—Wegner and Bretschneider

[57] ABSTRACT

There is disclosed a bag making machine for producing bags from an elongate strip of plastic web material. The disclosure relates to various improvements in the bag making machine such as the apparatus for forming the bag handle. This apparatus includes a stationary cutter and movable support plate for moving the web material into cutting engagement with the cutter. A novel reciprocal drive mechanism and coupling device are employed.

3 Claims, 13 Drawing Figures

CYLINDER

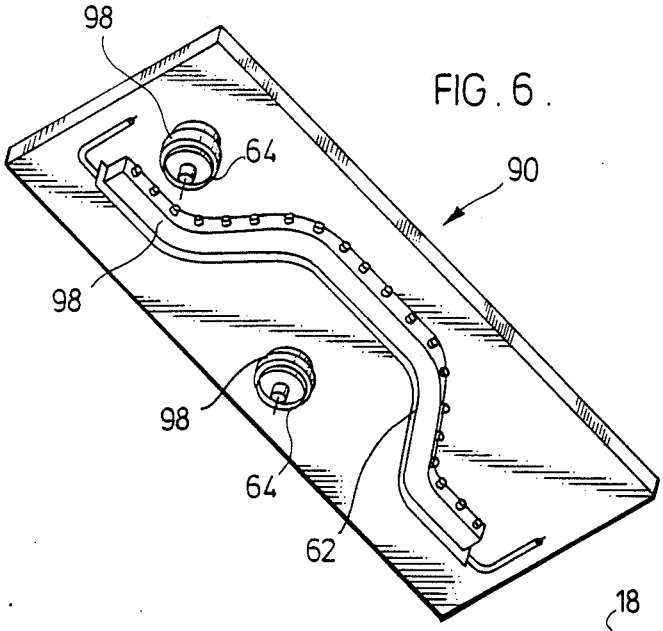
FIG. 6.
FIG. 5.
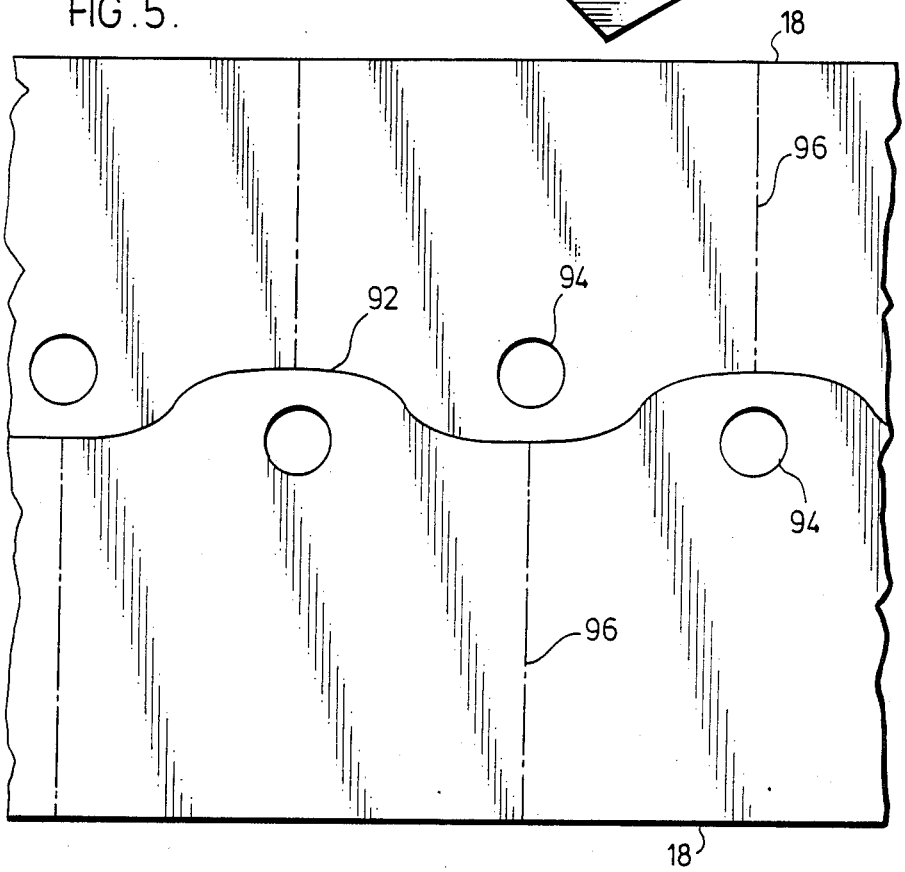

58
FIG. 7.
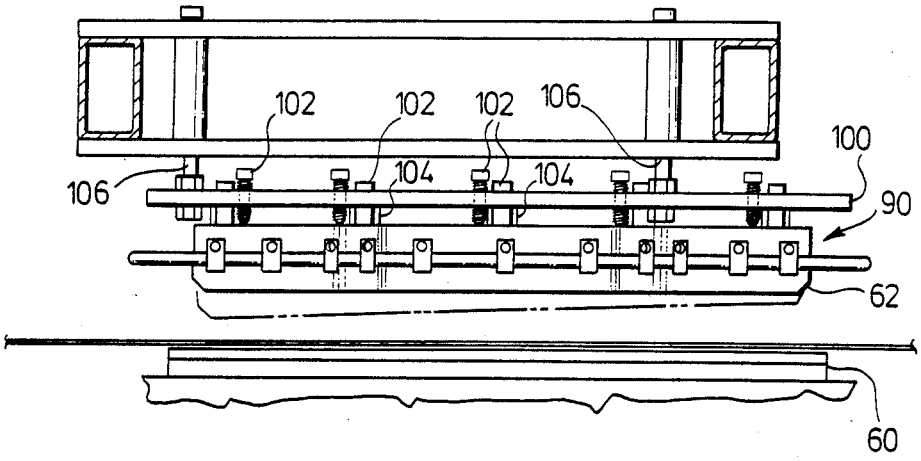
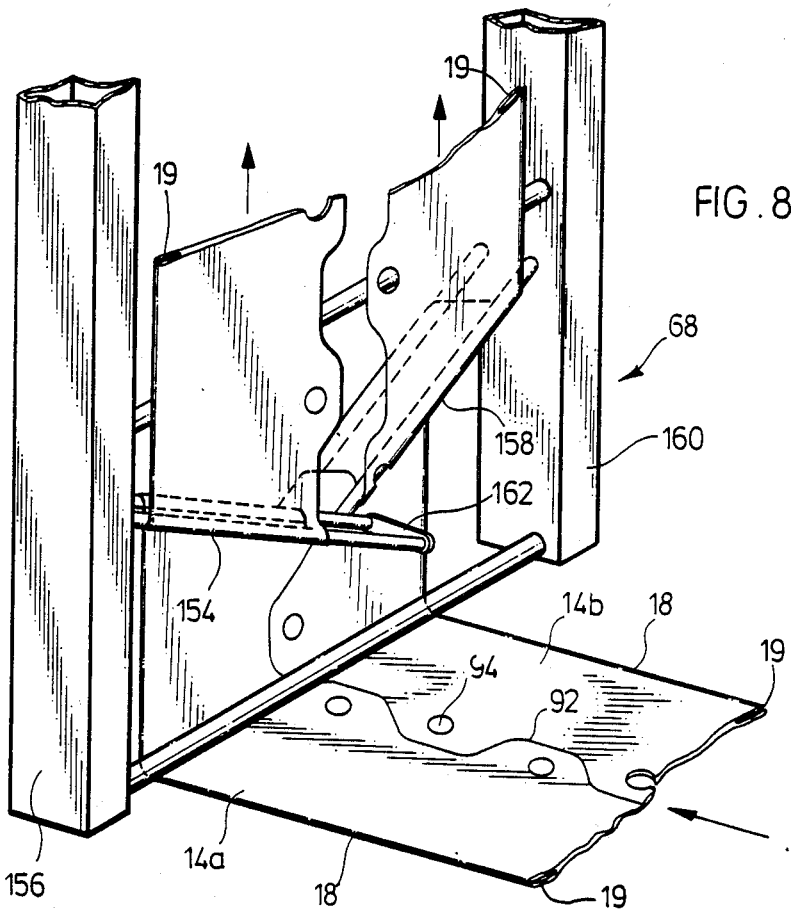
FIG. 8.

FIG. 11.
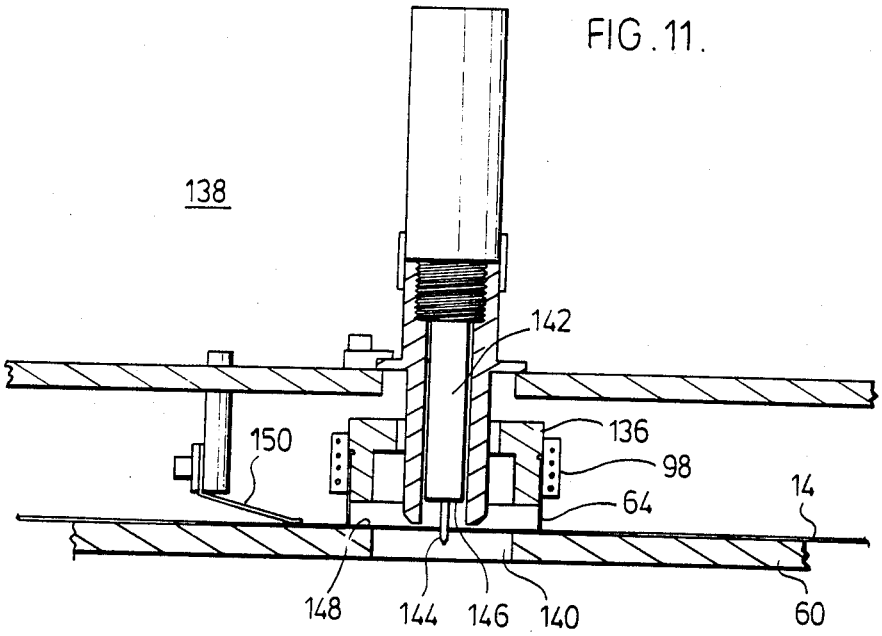
FIG. 12.
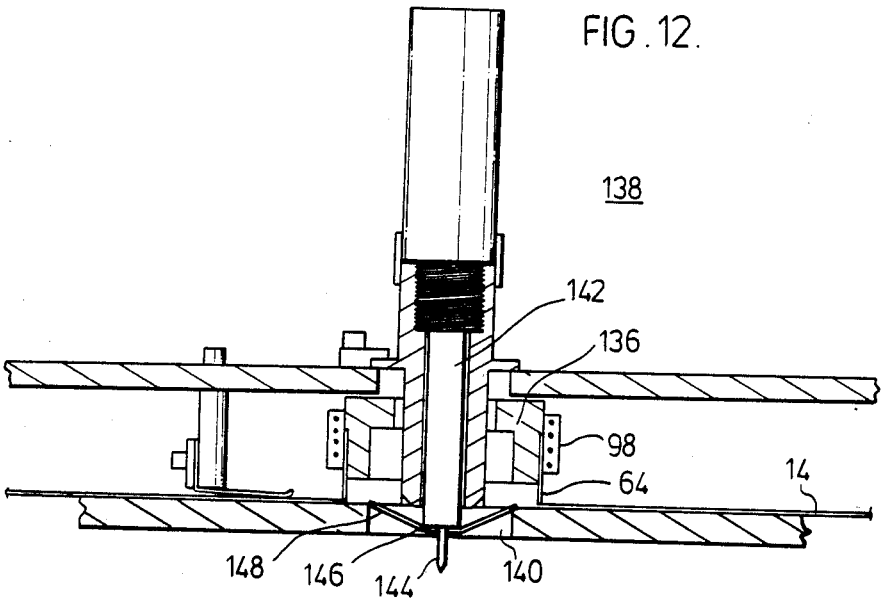
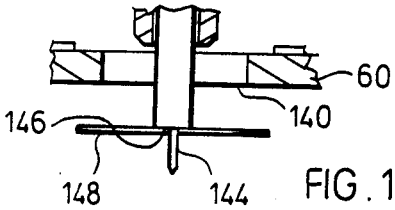
FIG. 13.

PLASTIC BAG HANDLE FORMING APPARATUS

The present invention relates to a bag making machine and more particularly relates to an improved machine for fabricating bags from plastic material in the form of an elongate tubular web.

It is known to form bags from tubular feed stock of thermosplastic web material wherein the tubular stock is flattened such that side edge creases or gussets are formed which define the bottom of the bag. This web material is fed into the bag machine where it is cut generally longitudinally to form the bag handles. The bag machine subsequently cuts and seals the plastic web transversely to the direction of the tube elongation to form the sides of the bag.

A problem associated with these machines involves the set-up of the bag handle cutting blade apparatus of the machine. In order to ensure that the bag handle portion is properly cut from the web portion, the cutting blade apparatus is set-up within a given tolerance of a set-up position and must maintain this position during machine operation. However, during the cutting of the bag handle, a lower support plate brings the web material into cutting engagement with the cutting blade and, to ensure the cut, the lower support plate pushes the blade cutting apparatus away from the set-up position of the blade. The blade must return to is set-up position or close thereto to continue to ensure that a proper cut is maintained. With continued operation, the blade is often forced from its set-up position requiring a time consuming re-set operation during which the machine is not operating. Also, the movement of the blade adds time to each cutting cycle of the bag machine and is therefore inefficient. Further, in order to ensure cutting engagement with the blade, the lower support plate imparts a considerable blow to the cutting blade apparatus during each cut which causes blade wear.

It is therefore an object of the present invention to provide a more efficient bag making machine.

It is another object of the present invention to provide a bag making machine having a handle cutting means which reduces wear and tear on the cutting blade.

In accordance with an aspect of the present invention there is provided in a bag making machine, an apparatus for forming bag handles from plastic web material. The apparatus comprises stationary cutting means arranged in a predetermined pattern to cut the bag handles. The apparatus further includes movable support means over which the web material travels. The movable support means is movable between a first position separated from the cutting means and a second position forcing the web material into cutting engagement with the cutting means. The apparatus includes reciprocally movable drive means for effecting intermittent movement of the movable support means between its first and second positions and coupling means interconnecting the drive means and the support means to translate reciprocating movement of the drive means into movement of the support means.

By providing for the cutting blade or cutting means to by stationary, the operation of the movable support means to bring the web material into cutting engagment with the stationary means is a quicker operation since it is not necessary for the cutting means to stabilize from previous cuts prior to initiating the next cutting operation. Furthermore, because the stationary cutting means does not move, there is less chance of it being forced out of its predetermined setting. Also, by having the reciprocal movable drive means drive the support means, the coupling means does not move through its full extent of travel and, as a result, the stationary cutting means does not have to move away from motion of the support means.

The displacement of the drive means may be varied by the coupling means such that the force exerted by the support means toward the cutting means increases as the support means moves into its second position while the force exerted by the drive means remains constant.

It is envisaged that the driving means may comprise one or more piston drive means, each having reciprocally movable pistons. The coupling means may comprise a cam which increases the momentum or force component in the direction that the movable support means moves as the stroke of the piston increases. As a result, the speed at which the movable support means rises into engagement with the cutting means decreases as it moves nearer the cutting means and the force at which it moves increases permitting for a pressing engagement between the cutting means and support means. The cam does not travel a full 180° and the maximum force exerted by the pistons is predetermined which permits the cutting means to remain stationary. As a result, the stationary cutting means does not have to compensate the force exerted by the support means and the longevity of the cutting edge is enhanced.

The stationary cutting means preferably includes a curved blade means for cutting the peripheries of the bag handle and two circular cutting blade means, one on either side of the curved blade for cutting coupons from the web material to form apertures of a first predetermined size from the bag handle. The support means includes an aperture extending therethrough for each circular cutting means. Each circular cutting means includes a plunger within the cutting periphery of the circular cutting blade means. The plunger is movable relative to the circular cutting blade means. The plunger includes piercing means on a leading face thereof. The support means aperture is greater in size than the plunger and less in size than the first predetermined size. The support means and circular cutting means are movable relative to one another to bring the web material into engagement with the circular cutting means whereby a coupon is cut from the web material. The piercing means pierces the web material and extends into the support means aperture to positively hold the web material proximate the cutting periphery as the coupon is cut. The circular cutting blade means includes means for actuating movement of the plunger into the support means aperture when the coupon is cut so as to eject the coupon from the web material upon withdrawal of the plunger from the support means aperture.

The preferred bag making machine further includes front web driving means located forward of the bag handle forming apparatus and rear web driving means located rearward of the bag handle apparatus. The front and rear web driving means are intermittently operable when the handle forming apparatus is non-operable to advance the web material from the rear web driving means toward the front web driving means. The rear web driving means includes adjustment means for varying the driving force of the rear web driving means whereby web tension between the front and rear web driving means is controlled.

In the preferred construction of the bag machine, the web material travels over separating means after being cut into first and second web portions by the stationary cutting means. The separating means comprises at least a first pair of parallel rods inclined at a first angle normal to the direction of elongation of the first web portion. The first web portion travels around a first rod of the first rod pair to alter its direction of web travel to include a component transverse to the direction of elongation of the first web portion and away from the second web portion. The first web portion travels around the second rod of the first rod pair to again alter the direction of web travel by eliminating the transverse component from the direction of travel. The separating means preferably includes a second pair of parallel rods inclined at a second angle normal to the direction of elongation of said second web portion. The second web portion travels around a first rod of the second rod pair to alter its direction of web travel to include a component transverse to the direction of elongation of the first web portion and away from the first web portion. The second web portion travels around the second rod of the second rod pair to again alter the direction of web travel by eliminating said transverse component from the direction of travel.

For a better understanding of the nature and objects of the present invention reference may be had by way of example to the accompanying diagrammatic drawings in which:

FIG. 5 is a view showing the manner in which the plastic web is cut generally longitudinally by the bag cutting apparatus, FIG. 6 is a bottom three dimensional view of the cutting means of the bag handle cutting apparatus;

FIG. 7 is a side view of the upper portion of the bag handle cutting apparatus;

FIG. 8 is a three dimensional view showing the separating apparatus;

FIGS. 10, 11 and 12 are side sectional views showing the operation of the apparatus for cutting the bag handle holes; and, FIG. 13 is a partial side sectional view of the plunger apparatus of the circular cutting apparatus.

Figures 1, 2:
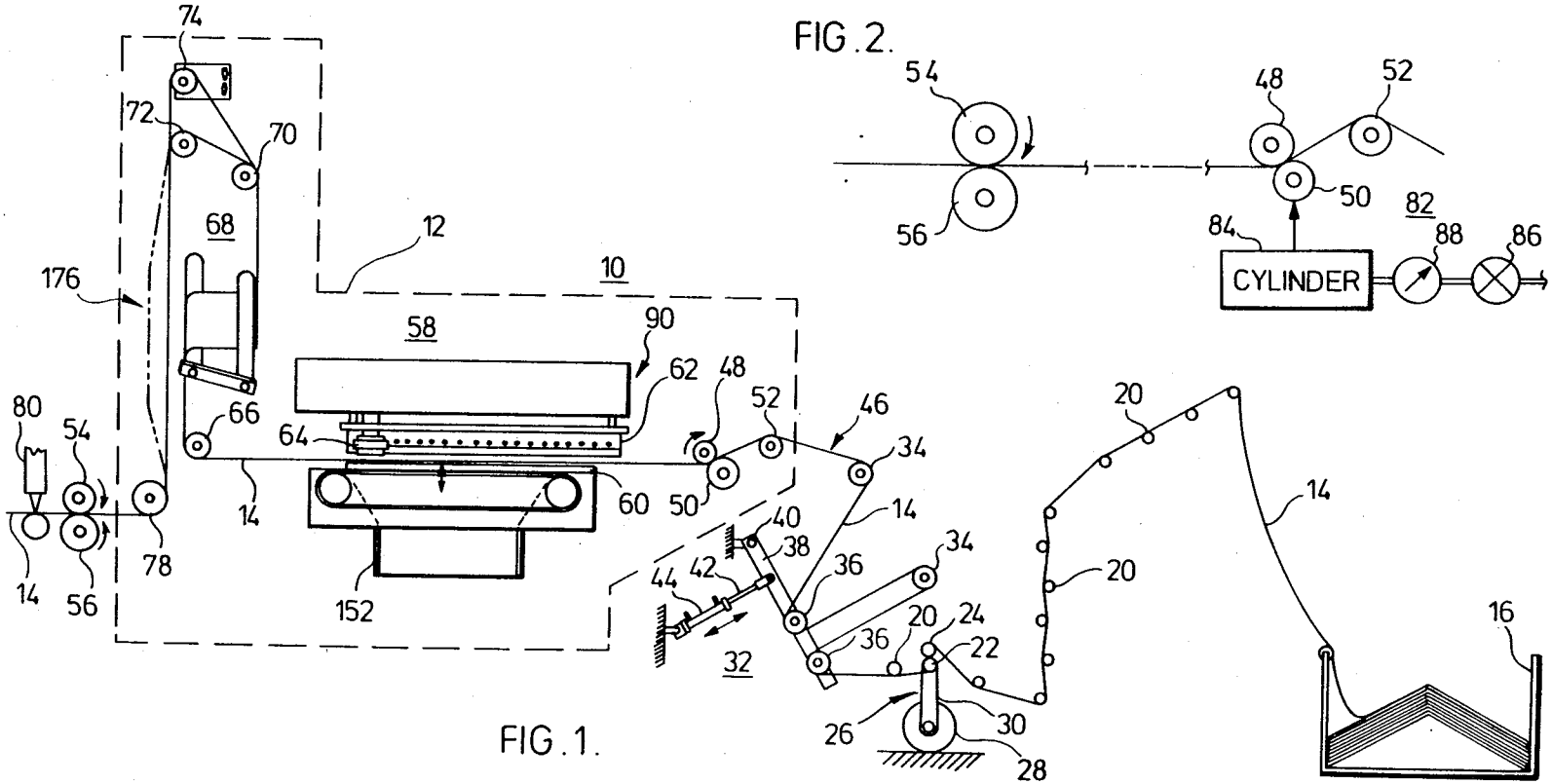
FIG. 1 is a schematic representation of a bag making machine.
FIG. 2 is a partial schematic view showing the relationship between the driving rollers of the bag making machine.

Referring now to FIG. 1 there is shown schematically a bag making machine 10 of the present invention. The improvements in the bag making machine are, for the most part, contained within dotted lines 12. The remainder of the machine is similar to that shown and described in Canadian Pat. No. 947,556 issued May 21, 1974 to G. G. Plate.

An elongate web material 14 is drawn from a bin 16. Web material 14 comprises a flattened tubular thermoplastic web material having gussets 19 (see FIG. 8) formed where the web material is flattened along its outside edge 18 parallel to the direction of elongation of the material. The outside edges 18 form the base of the plastic bag yet to be manufactured by bag making machine 10. The web 14 is drawn through idler rollers 20 by drive roller 22 of the capstan nip rollers 22 and 24. The web material wraps about the drive roller 22 to minimize slippage of the web material thereon. The drive roller 22 forms part of a capstan drive 24 which comprises a drive motor 28 operatively connected to a rubber covered drive roller 22 by means of a chain or pulley 30. The web material is then fed through a compensator generally shown at 32. The compensator comprises a plurality of idler rollers 34 journaled for rotation in a fixed position and a plurality of idler rollers 36 supported by a bar 38. Bar 38 is pivotally secured at 40 and pivotally secured to piston rod 42. While the piston rod is shown, it should be understood that a spring could also be used. The bar 38 is designed to pivot about point 40 so as to allow for a predetermined range of tensions to be applied to the web material as it travels through the bag making machine. As a result, the piston 44 maintains a constant uniform pressure on arm or bar 38 regardless of the relative position of bar 38. The travel of the bar 38 is sensed by appropriate sensing means and when the travel of the bar extends beyond a predetermined displacement in either direction, the angular velocity of motor 28 is altered accordingly so as to return the bar 38 to within its range of movement and thereby maintain a predetermined range of tensions on the web material at position 46 of the web travel path through the bag making machine.

The web material 14 passes about rear nip web driving rollers which have been referred to previously as rear web driving means. The rear web driving means comprise a rear driving roller 48, a rear nip idler roller 50 abutting roller 48, and an idler roller 52 which controls the angle of wrap about roller 48. Roller 48 is intermittently operated in conjunction with intermittent operation of front drive roller 54 shown towards the left in the drawing. Front drive roller 54 abuts idler roller 56 and acts to draw the web through the bag cutting apparatus. Rollers 54, 56 have been previously referred to as the front web driving means. The relationship of drive roller 48 and drive roller 54 is better shown in FIG. 2 and shall be described in more detail after a further discussion of the bag operating machine. As the web is intermittently driven past rear drive roller 48, it is driven between the bag handle cutting apparatus 58 of the bag machine 10. The cutting apparatus 58 cuts the handles from the bag by cutting the circular handle aperture and by cutting the web in a longitudinally extending wave form to provide the bag handle peripheries. The cutting of the bag handle peripheries and apertures is achieved simultaneously by moving support means or lower plate 60 into cutting engagement with the cutting means or cutting blade 62 and circular cutting apparatus 64.

After the web is cut, the web passes in two portions past idler pulley or roller 66 and over a web spreading means or apparatus generally shown at 68. This apparatus causes the two web portions to spread apart. On of the two web portions then passes over idler rollers 70 and 72 while the other web portion passes over idler rollers 70 and 74 to effect a phase shift such that the handles of the bag are brought into alignment. The handles of the bag may then be folded at station 76 prior to the web portions passing about drive assist roller 78 and through the drive rollers or draw rollers 54, 56. Subsequent to this a cutting and sealing bar 80 cuts the bag or web portion transversely of the direction of elongation of the web material so as to cut the side edges of the bag. The sealing bar seals the side edges.

Referring now to FIGS. 1 and 2, the rear web driving means is shown to comprise, in addition to rear drive nip rollers 48, 50 and idler rollers 52, an adjustment means 82. The adjustment means comprises a cylinder 84 operably connected to the idler roller 50 of the rear nip rollers. In practice, two cylinders are connected to opposing spindle ends of the idler roller 50. The purpose of the cylinder 84 is to move roller 50 into pressure or nipping engagement with rear nip drive roller 48. The cylinders 84 are pressured by a suitable fluid, such as air for example. A valve 86 is provided to control fluid pressure to the piston and a pressure gauge 88 permits the operator to monitor the pressure. By controlling the pressure of the rear nip drive rollers 48, 50, their driving force is regulated. In practice, slippage between rollers 48, 50 is in the order of 4 to 5%; however, web slippage can be reduced or controlled by using the adjustment means to increase the nip pressure. As a result, the amount of web material drawn between rollers 48, 50 is controlled. The rear nip rollers 48, 50 are of a slightly larger diameter than the front nip rollers 54, 56 and the rear rollers 48, 50 are geared to rotate such that their peripheral speed is slightly greater than that of front rollers 54, 56. It is, however, the amount of slippage between rollers 48, 50 that controls the amount of web drawn by rear nip rollers 48, 50. In this regard, the valve 86 of the adjustment means 82 is usually set by the machine operator such that during each cycle of operation the rear nip rollers 48, 50 draw slightly more web material therethrough than the front nip rollers 54, 56. The web driving rollers 48, 50 comprise a pair of rubber covered nip rollers around which the web material is partially wrapped due to the position of idler roller 52.

Rollers 66, 70, 72 and 74 are rotated when the web is driven or fed through the machine on an intermittent basis. When the front drive rollers 54, 56 stop driving the web, the rollers 66, 70, 72 and 74, have a momentum associated with each roller which causes them to slip relative to the web material. In the present invention, the driving rollers 48, 50 act as a brake preventing the web from stretching further due to the rollers temporarily continuing to rotate. Further, because the rollers 48, 50 and 54, 56 positively hold the web material in a controlled position therebetween and isolated from compensator 32, the web material does not tend to float resulting in a more accurate, quicker cut by the cutting means 58.

Referring now to FIGS. 3 through 7 the cutting means 58 is described. Referring in particular to FIG. 7 the cutting means is shown to comprise a stationary cutting means 90 having a cutting blade 62 of predetermined curvature to cut the periphery of the bag handles and two circular cutting blades 64 (see FIG. 6) disposed on opposing sides of the cutting blade 62 for cutting the bag handle apertures from the plastic web material. The cutting means 58 further comprises a movable support means or plate 60 which is movable relative to the stationary cutting means 90 to bring the plastic web material 14 into cutting engagement with the blades 62 and 64. Referring to FIG. 5 the pattern cut from the web material is shown to comprise a longitudinally extending gently curved wave form 92 and circular apertures 94. The broken lines 96 indicate those areas along which the bags must be cut and sealed by the sealing and cutting bar 80 at a later sequence in the operation.

Each of the blades 62 and 64 are provided with a heater element 98 attached thereto. The purpose of heater element 98 is to enhance the cutting ability of the cutting blades.

The cutting blade is attached to a mounting plate 100 by means of push pull bolts 102 and spacers 104. The purpose of the push pull bolts is to provide for fine adjustment of the cutting blades 62, 64 relative to the lower support means or support plate 78. Bolts 106 provide for gross adjustment of cutting blades.

Figures 3, 4:
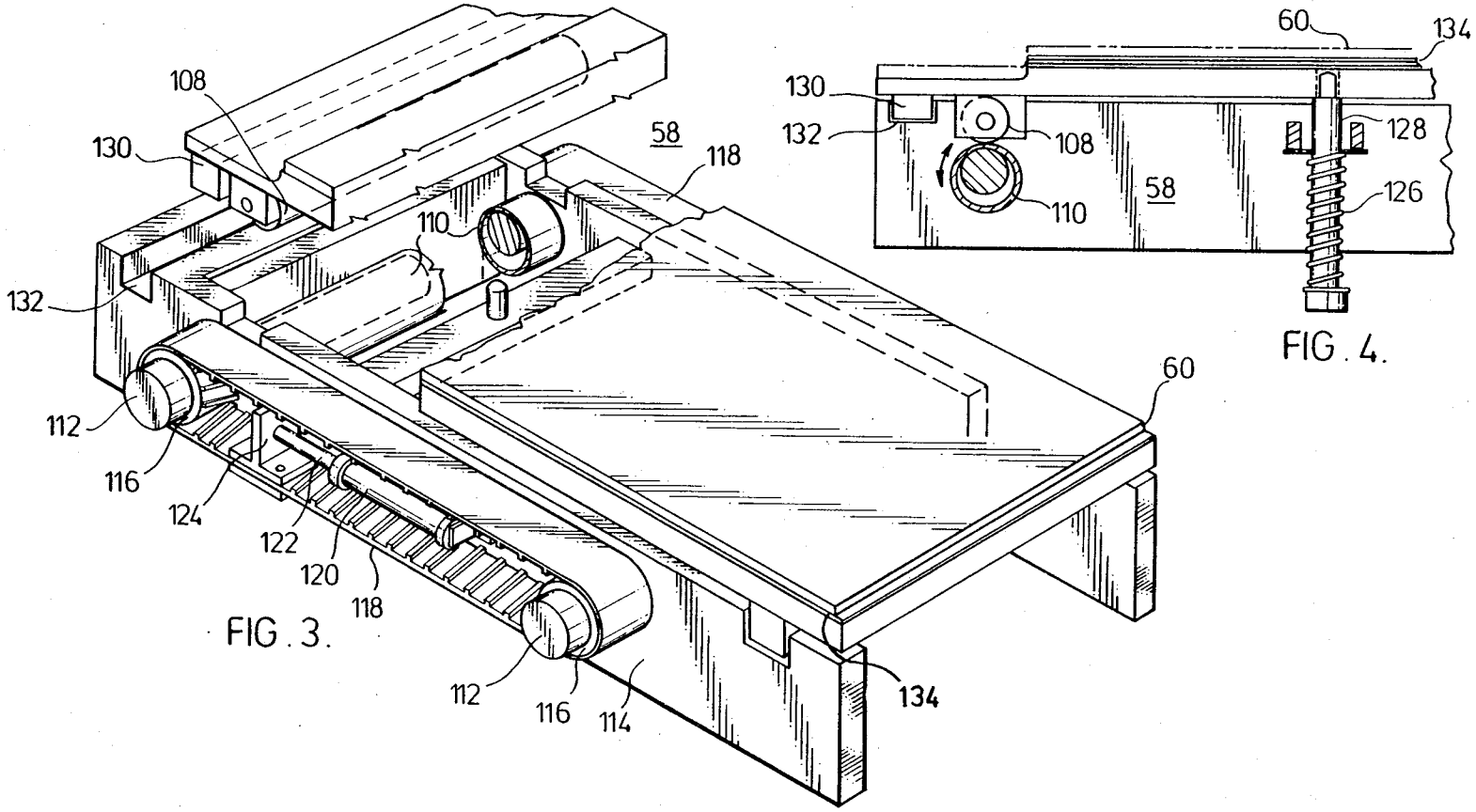
FIG. 3 is a three dimensional view of the movable supporting portion of the bag handle cutting apparatus.
FIG. 4 is a partial side sectional view of the movable supporting portion of the bag handle cutting apparatus.

Referring now to FIGS. 3 and 4 the lower support plate 60 is shown to comprise cam follower rollers 108. The two cam follower rollers 108 are provided adjacent each of the ends of the plate support means 58. Beneath each of the cam follower rollers 108 there is provided a cam or eccentric roller 110. At each of the ends of the plate 60 there is provided an axle 112 which passes through assembled side plates 114 so as to align and coordinate the rotation of the two cams 110. The axle 112 is journalled for rotation in the side plates 114 of the assembly and is provided with a timing belt pulley 116. The pulleys 116 on each side of plate 60 are surrounded by a respective timing belt 118. The timing belt 118 is moved by means of piston drive means 120. Piston drive means 120 comprises the reciprocal drive means of the present invention and is pneumatically operated. Two pistons 120 are provided on either side of the assembly 58 so that both timing belts 118 are driven in unison and the axles 112 act to coordinate the force applied by cams 110 to the rollers 108. As the cams 110 rotate beneath rollers 108, the plate 68 is lifted uniformly upward towards the cutting means 90. The piston 120 has its piston rod 122 attached to bracket 124 which is in turn attached to the belt 118 by suitable means such as, for example, bolts. By having the cams 110 actuated by reciprocal movement of the pistons 120, the cams 110 do not have to travel a full 180° so that maximum travel of the plate 60 is not achieved. In fact, the apparatus is designed such that the stroke of pistons 120 is such that cams 110 rotate less than 180° and in particular, about 160°. As piston 120 is driven, it imparts motion to the coupling means which includes plates 124, belt 118, pulley 116 and cam 110. The pistons 120 are intermittently operable when the web material 14 is not being driven through the bag machine. The support plate 60 is thus movable between a first position separated from the cutting means 90 and a second position bringing the web material 14 into engagement with the cutting means 90. A return spring 126 and shank 128 are provided to assist the return of the plate to its position separated from the cutting means 90. Guide bars 130 of the support plate 60 are movable in grooves 132 of assembly 114 to maintain the position of the support plate. By providing a cam or cams 110, a lever action is provided such that the force exerted by the support means 60 towards the cutting means 90 varies, and in particular increases, while the force exerted by drive means remains constant. This results in an upward movement of the plate 60 which decreases in speed as the displacement towards the cutting means increases and which increases in force as the displacement increases. As a result the impact momentum of the plate is reduced while the cutting force is increased. Thus, the cutting means 90 does not have to compensate for movement of the plate 60 allowing the cutting means 90 to remain stationary.

It should be understood that a resilient material 134, such as rubber for example, is provided beneath plate 60 to absorb shock.

Referring to FIGS. 10 through 13 of the present invention, the circular cutting means of the present invention is shown. The circular cutting means of the present invention is provided for cutting the circular aperture 94 in the bag handles. The cutting apparatus includes a circular cutting blade 64 having a heater 98 provided therearound. The heater 98 is adapted to hold the blade in place on block 136. The cutting blade 64 cuts a circular aperture 94 from the web material which aperture 94 is of a first predetermined size. The cutting blade 64 of the cutting means or apparatus 138 are aligned above an aperture 140 in the movable support plate 60. The cutting means 138 futher includes a plunger 142 of a predetermined size which is less than the size of aperture 140. Further, aperture 140 is less than the size of the cutting blade 64. As the plate 60 brings the web material 14 up into engagement with the cutting blade 64 a piercing means 144 mounted on a leading face 146 of plunger 144 pricks or pierces the plastic as shown in FIG. 11. As the plate 60 continues to move upwardly, the cutting blade 64 cuts through the web 14 forming a coupon 148. The piercing portion 144 maintains its positive hold on the coupon 148 and moves rapidly downward until the coupon is forced through the smaller dimensioned aperture 116 (see FIG. 13) by movement of plunger 142. At this time the plunger 142 is retracted and the coupon 148 will force itself from the piercing element or pin 144. The actuation of the plunger occurs approximately when the actuating member 150 is contacted by the lower support plate means 60. By including the piercing element or piercing means 144 on the leading face 146 of the plunger 142, the plastic web 14 is positively located relative to the cutting periphery or cutting blade 64. This ensures for a proper position cut of the plastic material and as the plunger 142 is driven into aperture 140, the coupon is pulled by the plunger relative to the piercing member 144 and will be pushed through the aperture 140. Without the use of piercing member 144, the coupon may still be attached at one portion to the plastic and not be forced completely through the aperture. As a result, when the web material is intermittently driven, the coupon may be brought with it. Accordingly, the circular cutting apparatus 138 of the present invention effectively ejects the coupon therefrom. As shown in FIG. 1, a chute 152 may be provided for collecting and directing the ejected coupons into a bin for collection.

Figure 9:
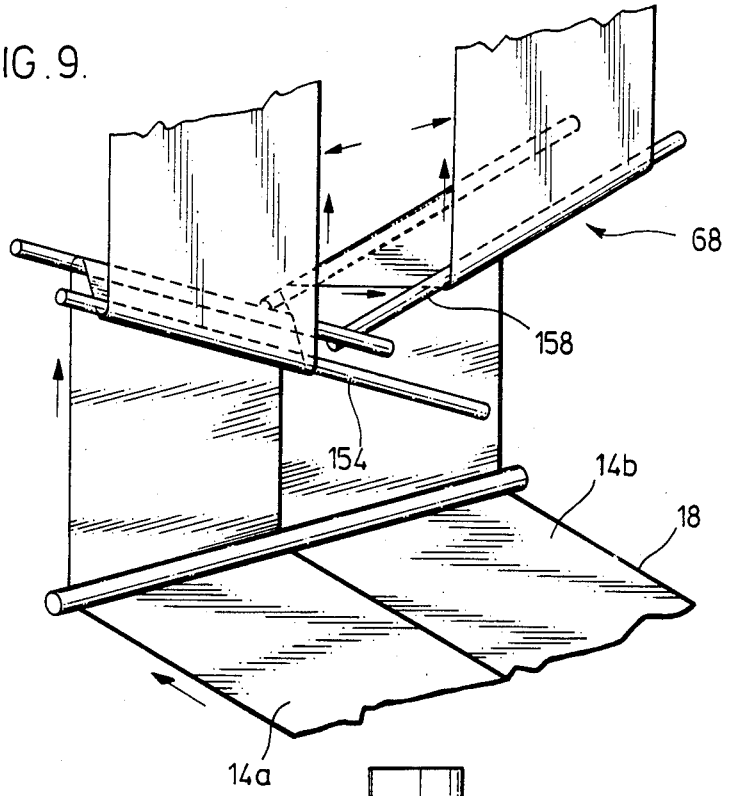
FIG. 9 is a schematic view showing the movement of the web over the separating apparatus.
Figure 10:
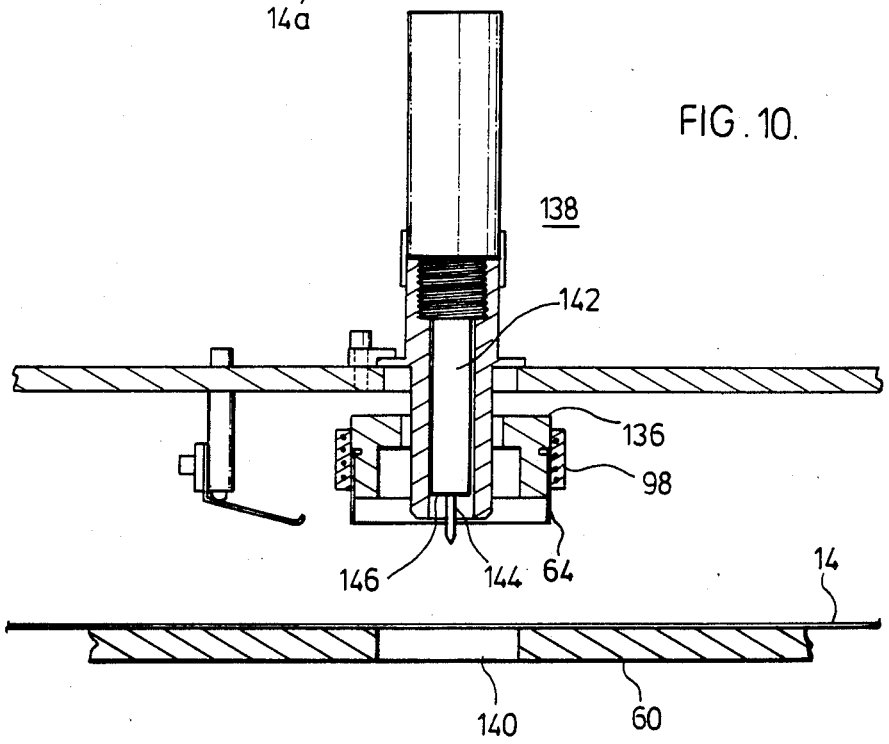

Referring to FIGS. 8 and 9, the separating apparatus in the present invention is shown. The separating apparatus 68 comprises a first pair of parallel rods 154 which are rigidly connected with side frame 156 and a second pair of parallel extending rods 158 which is rigidly connected to side frame 160. The rods 154 and 158 extend downwardly as shown in the drawings and extend at an angle inclined to the normal of the direction of elongation of the respective first and second web portions **14*a* and 14*b*. As web portion 14*a* rises, it passes over the rear rod of rods 154 and under the forward rod of rods 154. As web 14*a* passes over the rear rod of rods 154 it alters its direction of web travel to include a component which is transverse to the direction of elongation of the web portion 14*a* and away from the web portion 14*b*. As the web portion 14*b* passes over the forward rod of rods 154, it eliminates the transverse component therefrom. The other set of rods 158 are of similar design to rods 154 to effect a change in direction of web 14*b* as shown in the drawings. The rear rod and the forward rod of each of the pairs of rods 154 and 158 are designed such that the lower line defined by the forward rod is even with the upper line defined by the rear rod. The ends of the rods 154 are interconnected by interconnecting plates 162. Likewise the ends of rods 158 are connected by similar interconnecting rods which are not shown for the purpose of clarification. The rods 154 and 158 are positioned one above the other, overlap across the generally longitudinally extending line the web portions have been cut. As shown in the drawings, the separating apparatus 68** and the phasing above are on a vertical as opposed to the generally horizontal extending operations that the rest of the machine are performed. This saves floor space.

The embodiments of the invention in which an exclusive property or privilege is claimed are defined as follows:

1. A bag making machine comprising apparatus for forming bag handles from a plastic web material and means for passing the web material through said apparatus, said apparatus comprising:

stationary cutting means shaped to cut said bag handles, movable support means over which the web material travels, said support means being movable between a first position spaced from the cutting means and a second position forcing the web material into cutting engagement with the cutting means, reciprocally movable drive means, coupling means interconnecting said drive means and said support means to translate–reciprocating movement of said drive means into intermittent movement of the support means between said first and second positions, said coupling means comprising a pair of axels extending transversely of the directions of travel of the web material and longitudinally spaced in said direction, each axel carrying cam means engagable with the support means, a first flexible endless drive element in driving engagement with the axels adjacent one end thereof, a second flexible endless drive element in driving engagement with the axels adjacent opposite ends thereof, and said drive means comprising fluid pressure operated piston and cylinder means for each flexible endless drive element.

2. A bag making machine according to claim 1 wherein each said piston has a stroke which causes less than 180° rotation of each cam means as the support means is moved between the first and second positions.

3. A bag making machine according to claim 1 wherein the piston and cylinder means cause the pistons to exert a constant force, and said cam means cause the constant force from the pistons to be translated into an increasing force and decreasing speed with which the support means engages the cutting means.

* * * * *